US006502919B1

(12) United States Patent
Tanabe

(10) Patent No.: US 6,502,919 B1
(45) Date of Patent: Jan. 7, 2003

(54) INK JET RECORDING APPARATUS AND DISCHARGE RESTORATION METHOD

(75) Inventor: Takayuki Tanabe, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 14 days.

(21) Appl. No.: 09/706,736

(22) Filed: Nov. 7, 2000

(30) Foreign Application Priority Data

Nov. 8, 1999 (JP) ..... 11-317511

(51) Int. Cl.[7] ..... B41J 2/165
(52) U.S. Cl. ..... 347/23
(58) Field of Search ..... 347/23, 29, 30, 347/32, 33, 35

(56) References Cited

U.S. PATENT DOCUMENTS

| | | | | |
|---|---|---|---|---|
| 5,245,362 A | | 9/1993 | Iwata et al. | |
| 5,475,404 A | | 12/1995 | Takahashi et al. | 347/23 |
| 5,572,242 A | | 11/1996 | Fujii et al. | 347/23 |
| 5,592,200 A | | 1/1997 | Kaneko | 347/30 |
| 5,742,302 A | * | 4/1998 | Kohri et al. | 347/23 |
| 5,900,889 A | | 5/1999 | Tsukuda | 347/23 |
| 6,027,212 A | * | 2/2000 | Tanno et al. | 347/108 |

FOREIGN PATENT DOCUMENTS

| | | | | |
|---|---|---|---|---|
| EP | 0 480 473 | | 4/1992 | |
| EP | 0 608 104 | | 7/1994 | |
| EP | 0 844 094 | | 5/1998 | |
| JP | 3-234541 | | 10/1991 | |
| JP | 3-234543 | | 10/1991 | |
| JP | 6-8458 | | 1/1994 | |
| JP | 9-109384 A | * | 4/1997 | B41J/2/01 |
| JP | 10-44396 | | 2/1998 | |

* cited by examiner

*Primary Examiner*—Michael Nghiem
*Assistant Examiner*—Shih Wen Hsieh
(74) *Attorney, Agent, or Firm*—Fitzpatrick, Cella, Harper & Scinto

(57) ABSTRACT

An ink jet recording apparatus comprising: a restoration device for executing restoration of a discharge opening through which ink is discharged for recording; an openable cover for covering a recording device relevant to the recording; a detecting device for detecting whether said cover is in an open state or a close state; a switch provided in a position in which said switch is covered with said cover when said cover is in the close state and can be turned on when said cover is in the open state; and a control device for controlling the execution of the restoration of said discharge opening by said restoration device, if said detecting device detects that said cover is in the open state, and said switch is turned on.

17 Claims, 4 Drawing Sheets

INK JET RECORDING APPARATUS AND DISCHARGE RESTORATION METHOD

BACKGROUND OF THE INVENTION

1. Field of the Invention

The present invention relates to an ink jet recording apparatus and a discharge restoration method for the apparatus. The present invention can be applied to printers, copying machines, facsimiles having communication systems, apparatuses such as word processors having printer sections, and industrial recording apparatuses compositely combined with different types of processors, which perform recording on recording media such as paper, yarns, fibers, fabrics, leather, meals, plastics, glass, wood materials, and ceramics. In the present invention, the term of "recording" means rendering to a recording medium not only images such as letters, figures, and so forth which have meanings to be transmitted, but also images such as patterns and so forth which have no implications.

2. Description of the Related Art

In recent years, ink jet recording apparatuses have been widely used, in which a recording head provided with plural discharge openings is caused to scan along a recording medium, and droplets of ink are discharged through the discharge openings to the recording medium for recording.

In such an ink jet recording apparatus, ordinarily, before the recording starts or at exchange of the ink tank or the recording head, so-called discharge restoration such as preparatory discharge or suction restoration is performed. The discharge restoration is carried out in order to remove foreign matters such as relatively large bubbles contained in thickened ink in the vicinity of the discharge openings or ink in the recording head whereby desirable discharge conditions are obtained. Especially, in many cases, when the ink tank is exchanged, relatively intensive suction-restoration, and additionally, preparatory discharge are performed.

In order to exchange an ink tank in an ink jet recording apparatus, ordinarily, a cover for exchanging the ink tank is opened. In particular, when a user opens the cover to exchange the ink tank, the recording head having the ink tank mounted thereto is automatically moved to an ink tank exchange position. The user removes the used ink tank, mounts a new ink tank thereto, and closes the cover. Then, the suction is automatically performed.

FIG. 5 is a flowchart showing a conventional processing routine at opening-closing of the cover.

First, it is determined whether image data to be recorded has been transmitted from a host computer (step 41). If the image data has been transmitted, then command analysis is executed, and recording-operation is performed (step 49). To the contrary, while image data is not transmitted, that is, in the recording-waiting state, it is detected whether the cover has been opened or closed by means of a sensor switch provided so as to work in coordination with opening-closing of the cover (step 42), and it is determined whether the cover has been opened or closed (step 43). If it is determined that the cover has been opened, then the recording head is moved to the ink exchange position (step 44). Furthermore, it is detected whether the cover has been opened or closed by mean of the above sensor (step 45), and it is determined whether the cover has been closed or not (step 46). If it is determined that the cover has been closed, the recording head is moved to the home position at which a suction mechanism is provided (step 47), and the suction restoration is executed (step 48).

As described above, many of conventional ink jet recording apparatuses each have such a mechanism that when the open-close operation of the cover is detected, it is decided that the ink tank has been exchanged, and the suction restoration is automatically performed.

However, a user opens the cover not only to exchange an ink tank but also to check recording- state or the remaining quantity of ink in the ink tank, and so forth during recording operation. Thus, in many of the conventional ink jet recording apparatuses, the suction restoration is automatically performed, even if the cover is opened-closed not for the purpose of exchanging an ink tank, as described above. Accordingly, the ink is consumed in vain.

Furthermore, when the recording head is exchanged, similar problems arises. That is, a user opens the cover not only to exchange the recording head, but also for other purposes, e.g., in order to check recording-state during recording operation or the state of ink stuck to the discharge opening face and so forth of the recording head. In many conventional ink jet recording apparatuses, the suction restoration is automatically performed, even if the cover is open and closed not to exchange an ink tank, as described above. Accordingly, the ink is uselessly consumed.

SUMMARY OF THE INVENTION

Accordingly, it is an object of the present invention to provide an ink jet recording apparatus and a discharge restoration method, in which restoration can be securely performed when the cover is opened and the recording head is exchanged, and the restoration is not executed when the cover is open and closed for another purpose, not to exchange an ink tank or a recording head, whereby useless consumption of ink can be reduced.

It is another object of the present invention to provide an ink jet recording apparatus and a discharge restoration method, in which a switch as a means for inputting information with respect to the restoration is provided under the cover, whereby such situations that a user turns the switch on by mistake, causing the restoration to consume ink vain, and so forth can be avoided.

It is yet another object of the present invention to provide an ink jet recording apparatus comprising: a restoration means for executing restoration of a discharge opening through which ink is discharged for recording; an openable cover for covering a recording means relevant to the recording; a detecting means for detecting whether said cover is in an open state or a close state; a switch provided in a position in which said switch is covered with said cover when said cover is in the close state and can be turned on when said cover is in the open state; and a control means for controlling the execution of the restoration of said discharge opening by said restoration means, if said detecting means detects that said cover is in the open state, and said switch is turned on.

It is still a further object of the present invention to provide an ink jet recording apparatus comprising: a restoration means for executing restoration of a discharge opening through which ink is discharged for recording; an openable cover for covering a recording means relevant to the recording; and a switch for inputting a command relevant to said restoration means and provided in a position in which said switch is covered with said cover when said cover is in the close state, and can be turned on when said cover is in the open state.

It is a further object of the present invention to provide a discharge restoration method comprising steps of: detecting that an openable cover for covering a recording means relevant to recording is in an open state; turning on a switch provided in a position in which said switch is covered with said cover when said cover is in a close state and can be turned on when said cover is in an open state, if said cover is in the open state; and controlling an execution of a restoration of a discharge opening through which ink is discharged for recording, if the open state of said cover is detected and said switch is turned on.

According to the present invention, if the cover is opened and closed, and in addition, a user exchanges an ink tank or the recording head, the restoration is executed. If the user does not exchange the tank or the head, the restoration is not executed. Thereby, the restoration can be executed, only when it is required, and useless consumption of ink can be suppressed. Moreover, the time period when the unnecessary restoration is carried out can be eliminated. Thus, the recording work efficiency can be enhanced. Moreover, advantageously, even if the user opens the cover to check the recording state for recording and so forth, the recording operation is not stopped. Thus, the user can be prevented from feeling uneasy.

In addition, according to the present invention, such situations that the user turns the switch on by mistake, causing the restoration which results in useless consumption of ink can be prevented by providing the switch as a means for inputting information with respect to the restoration.

Further objects, features and advantages of the present invention will become apparent from the following description of the preferred embodiments (with reference to the attached drawings).

DESCRIPTION OF THE PREFERRED EMBODIMENTS

Some embodiments of the present invention will hereinafter be described with reference to the drawings.

Figure 1:
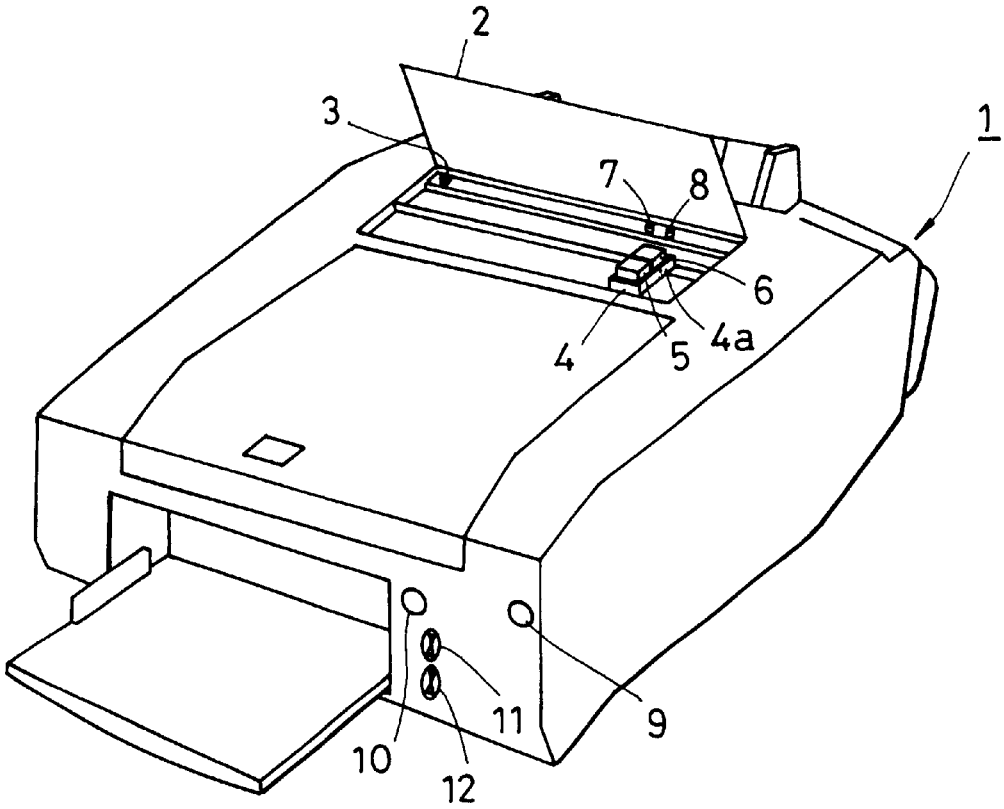
FIG. 1 is a schematic perspective view of a printer as an ink jet recording apparatus according to an embodiment of the present invention.

FIG. 1 is a schematic perspective view showing a printer as an ink jet recording apparatus according to an embodiment of the present invention.

A printer 1 is provided with a cover 2 for exchanging ink tanks 5 and 6, and a recording head 4*a* and formed as a part of a body cover constituting the casing of the printer. The cover 2 is provided with one side in the longitudinal direction thereof being axially supported on the outer frame body, so that the cover 2 can be opened and closed.

When the cover 2 is opened, movement of a carriage 4 having the recording head 4*a* and the ink tanks 5 and 6 mounted thereto, and moreover, recording state produced, accompanying the movement can be observed. In particular, the carriage 4 having the recording head 4*a* mounted thereto is provided slidably on a shaft 13 in the area in which the carriage 4 can be observed while the cover 2 is opened. During recording, the carriage 4 is moved to scan. In the movement, the recording head discharges ink as a droplet onto recording paper opposed to the recording head, whereby letters, images, and so forth are recorded. The carriage 4 can be moved by driving force of a carriage motor (not shown) transmitted through a belt (not shown).

The recording medium is conveyed by rotation of a conveying roller opposed to the recording head 4*a*. Also, whenever the recording head 4*a* mounted onto the carriage 4 performs one cycle of scanning, the recording medium is conveyed a predetermined distance orthogonally to the scanning direction. Accordingly, by repeating scanning of the recording head 4 and conveying a predetermined distance of the recording medium alternately, the recording can be made on the whole of the recording medium.

The recording head 4*a* is detachably mounted to the carriage 4, and can be exchanged similarly to the ink tanks as described later. The recording head 4*a* has the discharge opening face in which plural discharge openings are arranged, and is mounted onto the carriage 4 so as to be opposed to the recording medium.

Onto the carriage 4, the black ink tank 5 and the color ink tank (in the tank, inks of cyan, magenta, and yellow are reserved in different chambers which are integrally constructed) are detachably mounted. The ink tanks 5 and 6, and the recording heads corresponding to the ink tanks, while they are mounted onto the carriage 4, are in communication with each other through ink-feeding paths (not shown), whereby the inks are supplied to the ink paths of the recording heads, correspondingly. Heaters 54 (FIG. 3) are electro-thermal converting elements provided in the ink paths of the respective recording heads. The inks are heated by the heaters 54 so that bubbles are generated in the inks. By means of the pressure during formation of the bubbles, the inks are discharged as droplets. In this embodiment, the ink is discharged by a bubble-jet system. However, the present invention is not limited to this discharge system. For example, a system of discharging ink by means of a piezoelectric element may be employed.

Figure 2:
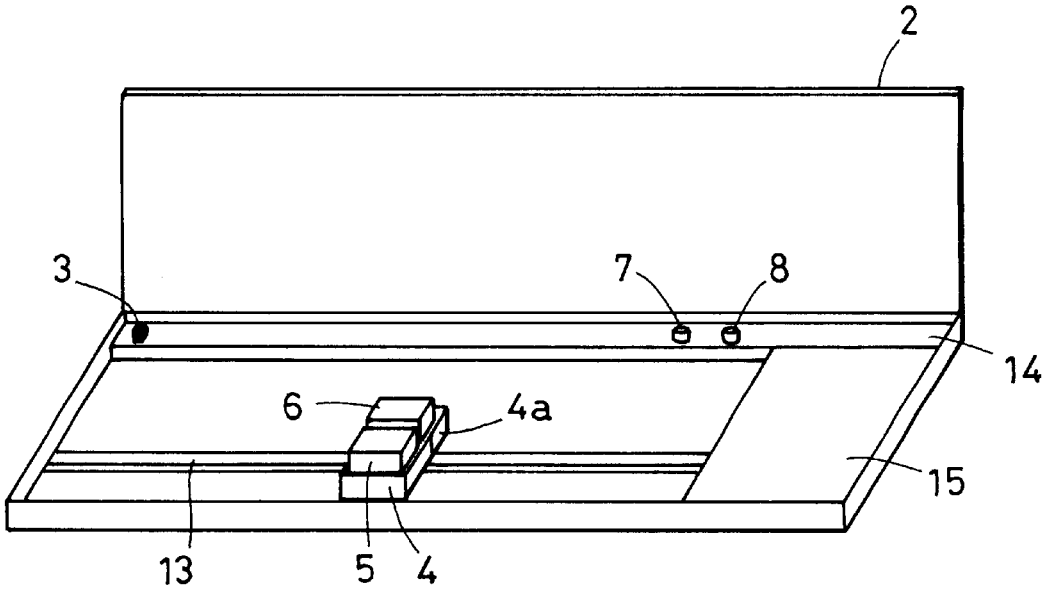
FIG. 2 is a schematic perspective view of the cover part of the printer.

FIG. 2 is a schematic perspective view showing the cover part of the printer.

When the cover 2 is opened, a switch panel 14 appears, which constitutes a part of the cover and is elongated in the longitudinal direction of the formed opening of the cover. The switch panel 14 is provided with a cover sensor 3, a color ink tank exchange completion switch 7, and a black ink tank exchange completion switch 8. The cover sensor 3 is brought into non-contact or contact with the cover 2, correspondingly to the opening and closing of the cover 2, to detect the state of the cover 2. This method of sensing the opening and closing of the cover 2 is not restrictive. Other sensing methods, e.g., using infrared rays or the like, may be employed.

The color ink tank exchange completion switch 7 and the black ink tank completion switch 8 are push button switches which a user can push down to inform the printer body that he has exchanged the ink tanks, respectively. Only when the cover 2 is opened, the switches 7 and 8 can be seen by the user, and then, he can recognize that these switches should be pushed when the tank exchange has been completed.

In this embodiment, only when the user pushes the switches 7 and/or 8, suction restoration of the recording heads is performed. When the switches 7 and 8 are not pushed, it is determined that the cover has been opened for another purpose, not to exchange the ink tanks, and the routine in which the suction restoration is not performed is implemented. This processing routine will be described in detail later.

As shown in FIG. 1, a manipulation panel having different types of operation switches to operate the printer body, which are collected together, is provided on a side-face of the body cover. In this embodiment, a power supply switch 9 for controlling the on-off of a power supply for the printer 1, and a selection switch 10 for performing the restoration or other selection, and decision are provided. Moreover, a color ink remaining amount alarm lamp 11 to light up when the remaining amount of ink in the color ink tank becomes small, and a black ink remaining amount alarm lamp 12 to light up when the remaining amount of ink in the black ink tank becomes small are provided in the vicinity of the operation switches.

Ordinarily, during waiting, after completion of recording-operation, or while the power supply does not work, the carriage 4 stops in a recording-wait position space 15 shown in FIG. 2. The recording-waiting position space 15 is provided with a cover which prevents a user from simply touching the carriage 4 and the recording head 4*a* stopping in the space 15, so that the appearance of the carriage 4 can be seen. The recording-waiting position is also called "home position".

In the recording-waiting position, a cap 53*a* (FIG. 3) for tightly closing the discharge opening face of the recording head 4*a*, and a suction pump 53 (FIG. 3) for suction-discharging ink in the discharge openings are provided. When the recording head 4*a* moves into the recording-waiting position, the discharge opening face is tightly closed with the cap 53*a* at any time so that ink in the vicinity of the discharge openings is protected from being dried. Furthermore, for example, when the power supply is put to work, or when the ink tanks are exchanged, the suction restoration is performed in which the suction pump 53 is operated to suck ink in the discharge openings, if necessary, whereby the ink sticking to the discharge openings and bubbles are removed.

Ordinarily, the cover 2 is closed, and when recording is not performed, the recording head 4*a* stops in the recording-position space 15. In this state, if a user opens the cover 2, the recording head 4 is moved from the recording-waiting position space 15, and stops in a predetermined position (ink tank exchange position) in the opening at which the user can touch the recording head 4.

Figure 3:
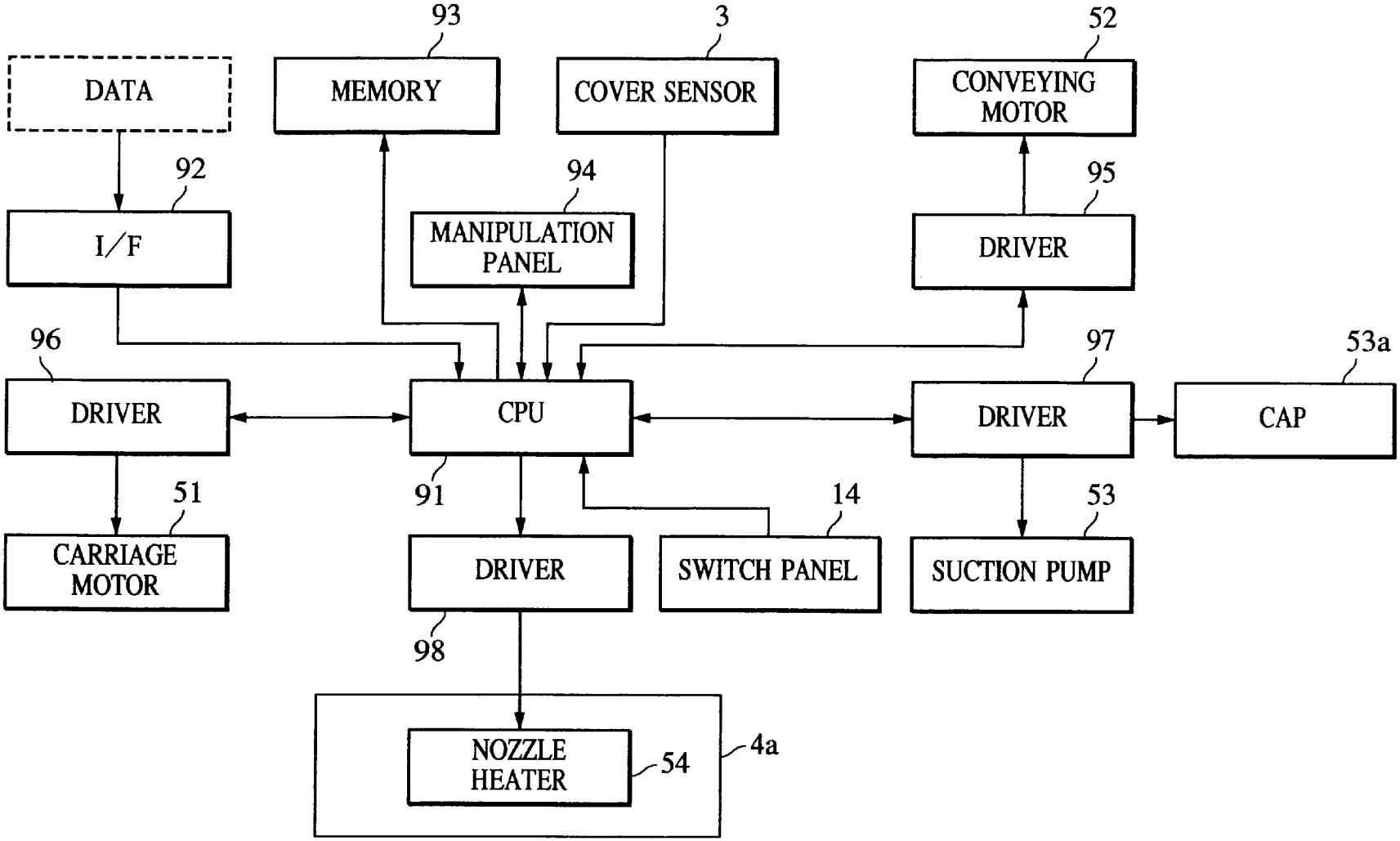
FIG. 3 is a block diagram showing the electric circuit arrangement of the printer.

FIG. 3 is a block diagram showing a circuit arrangement of the printer.

Control of the whole of the printer is performed by means of CPU 91. A recording command, and data such as image data or the like are transmitted from a host computer to the CPU 91 via an I/F section 92. The CPU 91 analyzes the transmitted date, and send drive commands to driving sections, respectively. The drive commands are sent via the drivers 95, 96, and 97 to drive a carriage motor 51, a conveying motor 52, the suction pump 53, and the heater 54, respectively.

Moreover, operation commands from the operation panel 94 and the switch panel 14, and sensing results obtained by the cover sensor 3 are sent to the CPU 91, if necessary. Moreover, the CPU 91 reads out a control program stored in a memory 93 to control according to the program, and in reverse, causes the memory to store data required for processing, if necessary.

In this embodiment, an ink tank exchange completion switch flag is provided in the memory area of the memory 93. Pushing the ink tank exchange switch causes the flag to be set. The CPU 91 determines whether exchange of the ink tanks has been performed or not, based on the set or reset of the flag. If the exchange has been performed, the drive commands are given to the cap 53*a* and the suction pump 53 to perform the suction.

(Embodiment 1)

Figure 4:
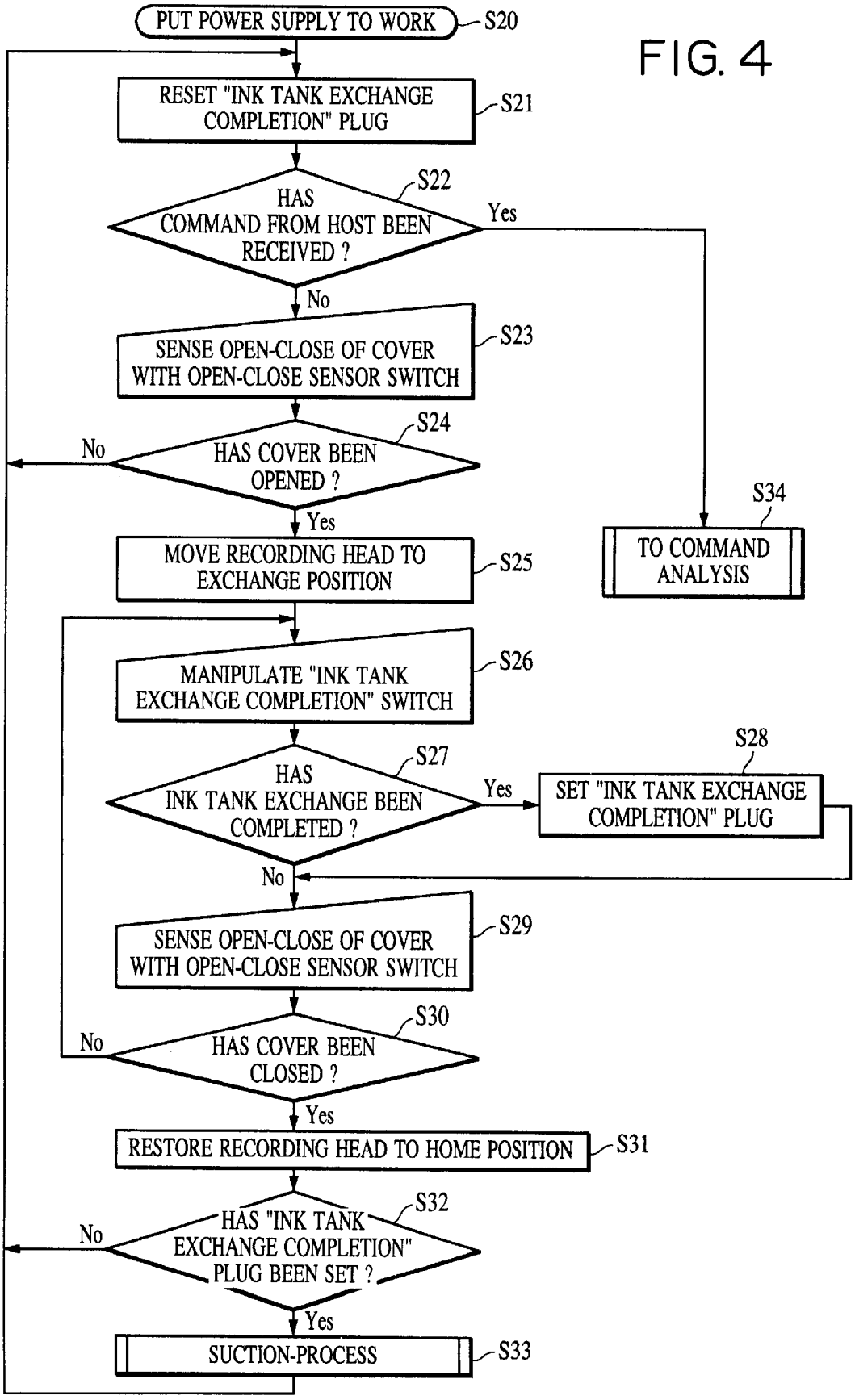
FIG. 4 is a flowchart showing processing at ink tank exchange according to an embodiment of the present invention.
Figure 5:
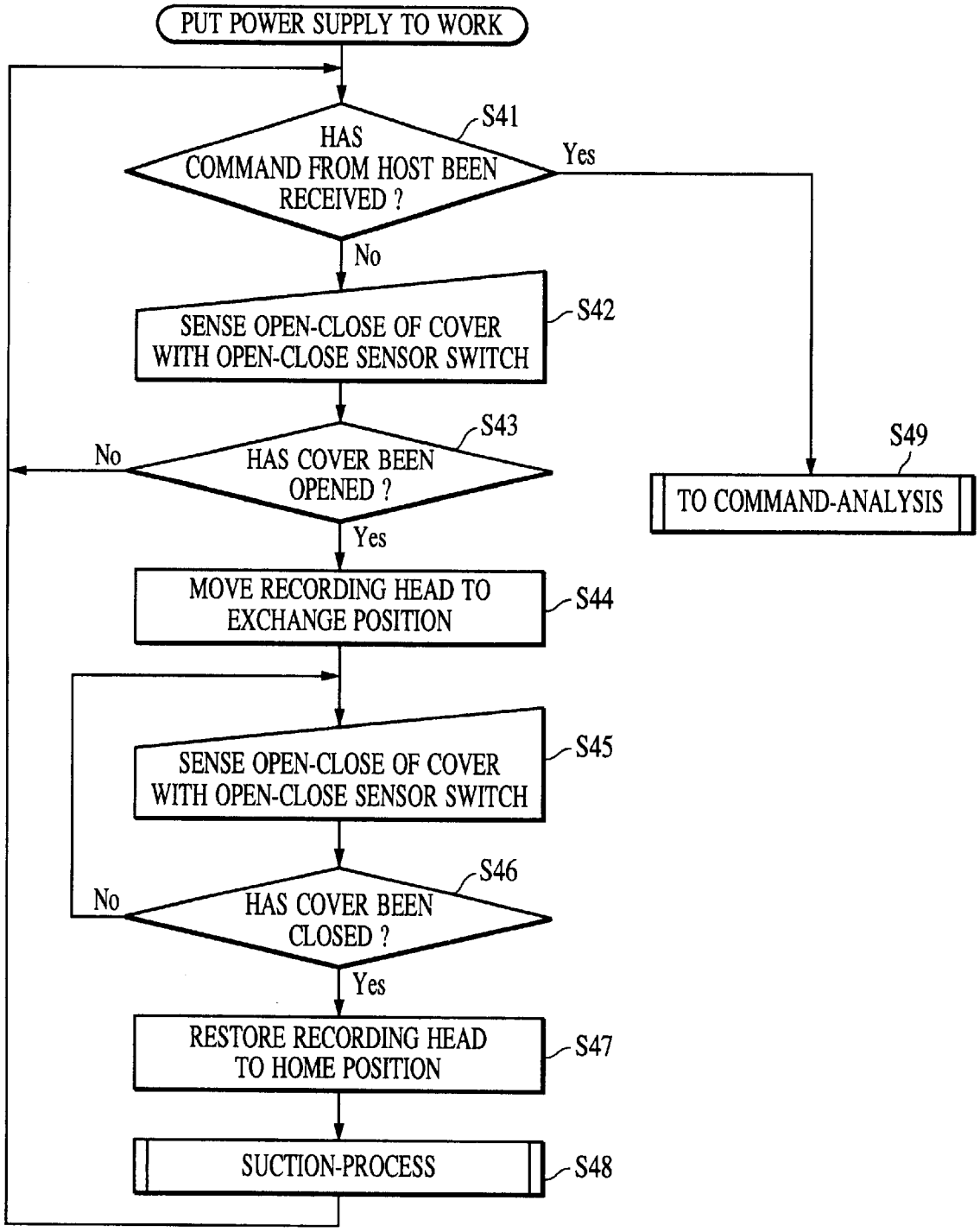
FIG. 5 is a flow chart showing conventional processing at ink tank exchange.

Hereinafter, the ink tank exchange processing routine will be described in detail. FIG. 4 is a flowchart showing the processing at exchange of an ink tank according to an embodiment of the present invention.

When a power supply for the printer 1 is put to work (step 20), the CPU resets the flag which is set by switching of each of the ink tank exchange completion switches 7 and 8 (step 21).

In waiting in this state, the CPU 91 determines whether a recording command has been transmitted from a host computer (step 22). If the recording command has been transmitted, then the CPU executes command analysis (step 34). On the other hand, if no recording command has been transmitted, the sensor switch 3 detects whether the cover 2 has been opened or closed (step 23), and it is determined that the cover has been opened (step 24), then the CPU 91 causes the recording head 4*a* to move from the recording-waiting position to the ink tank exchange position (step 23). That is, at this point, it can be assumed that the user has opened the cover for some purpose.

The user detaches an ink tank to be exchanged from the recording head 4*a* stopping at the ink tank exchange position, and attaches a new ink tank thereto. When the attachment is completed, the ink tank exchange switches 7 and/or 8 is pushed. When the ink tank exchange completion switch is operated (step 26), and the ink tank exchange is confirmed (step 27), the ink tank exchange flag is set (step 28).

When the user closes the cover 2, the cover sensor 3 detects the close state of the cover (step 29), and it is determined that the cover 2 has been closed (step 30). Then, the recording head 4*a* is moved to the recording waiting position (step 31). When the recording head reaches the recording waiting position, it is determined whether the ink tank exchange completion switch flag has been set or not (step 32). If the flag has been set, it means that the ink tank has been exchanged. Thus, the suction restoration processing is performed (step 33). When the suction is completed, the routine is returned to the step 21, in which the flag is reset.

A seen in the above description, only when the ink tank exchange completion switch is pushed, the cover is closed, and thereafter, the suction restoration is performed. When the cover is opened for another purpose, not for exchange of the ink tank, the suction restoration is not performed, though the cover is closed. Thereby, only the required suction restoration can be timely performed. Furthermore, the amount of ink uselessly consumed in unnecessary suction restoration can be decreased to the minimum.

(Embodiment 2)

In this embodiment, determining whether the suction restoration should be performed or not is made, based on a factor of the time period when the cover is opened, in addition to inputting by means of the ink tank exchange completion switch or not.

If the cover is opened for ink tank exchange work, the cover is kept in the open state for a considerably long time. On the other hand, if the cover is opened for the purpose of checking, e.g., recording-state, ordinarily, the open time of the cover is very short. At the point when the cover sensor 3 detects the open of the cover 2, the CPU 91 starts measuring the lapse of time, and stops the measurement at the point when the cover sensor 3 detects the close of the cover. If the measured lapse of time exceeds a predetermined value, it is determined that the ink tank exchange has been performed, even if the flag has not been set. (that is, even if the processing should proceed as shown in NO in the step 32 in FIG. 4), and the suction restoration routine is implemented.

As described above, by adding the factor of cover-open time to the routine, required suction restoration can be securely performed, even if the ink tank exchange completion switch should have been pressed after the user exchanged the ink tank.

(Embodiment 3)

In the embodiment 1, it is determined whether the suction restoration should be performed or not, based on inputting by means of the ink tank exchange completion switch or not. In this embodiment, a switch for inhibiting the suction restoration is provided instead of the ink tank exchange completion switch. When the cover is opened, the inhibiting switch is pushed, if the suction restoration is unnecessary, whereby the unnecessary suction restoration is not executed.

The switch for inhibiting the suction restoration is provided in the place where the switch can be seen by a user, namely, in the place where the ink tank exchange completion switches 7 and 8 are provided in the embodiment 1. When the user opens the cover, he pushes the switch for inhibiting the suction restoration, if the suction processing is unnecessary, and thereafter, closes the cover. In this case, the suction restoration of the printer is not performed, even if the cover is closed.

(Embodiment 4)

In the embodiments 1 to 3, the suction restoration using the cap and the suction pump is performed as discharge restoration. In this embodiment, the restoration by preparatory discharge is performed instead of or in addition to the suction restoration. The preparatory discharge means that ink, not relevant to recording, is discharged into an ink receptacle such as a cap.

(Embodiment 5)

In the embodiments 1 to 4, exchange of the ink tanks is detected, and the restoration is performed, depending on the sensing results. The present invention can be applied to exchange of the recording head, in addition to the ink tank exchange. In particular, a switch for inputting with respect to exchange of the recording head is provided instead of the ink tank exchange completion switch or in addition to the ink tank exchange completion switch, and the restoration is performed similarly to that of the embodiments 1 to 4.

Thereby, when the recording head is exchanged, only the required restoration can be performed. When a user opens the cover to confirm recording state while recording, or check the ink stuck to the discharge opening face or the like of the recording head, and so forth, unnecessary restoration is not performed. Thus, generation of useless, waste ink can be prevented.

As the recording head according to the present invention, the mode of a head chip in which ink is supplied from a separate ink tank to a head, and moreover, the mode of a head cartridge in which an ink tank is provided integrally with a head may be employed.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. An ink jet recording apparatus comprising:

a restoration means for executing restoration of a discharge opening of an ink jet recording head through which ink is discharged for recording;

a carriage for carrying said ink jet recording head and for executing a reciprocating movement within a movement region;

an opening cover for covering the movement region of said carriage and for opening and closing access to said movement region;

a detecting means for detecting whether said cover is in an open state or a close state;

a switch provided in a position in which said switch is covered with said cover when said cover is in the close state and can be turned on when said cover is in the open state; and a control means for controlling the execution of the restoration of said ink jet recording head, if said detecting means detects that said cover is in the open state, and said switch is turned on, while said control means does not cause the execution of restoration of said ink jet recording head, if said detecting means detects that said cover is in the open state, and said switch is not turned on.

2. An ink jet recording apparatus according to claim 1, wherein said switch is a switch to be turned on if said recording means is exchanged, and if said switch is turned on, said control means causes said restoration means to execute the restoration.

3. An ink jet recording apparatus according to claim 2, wherein a time period while said cover is in the open state is measured by said control means, and if the measured time period reaches a predetermined value, said control means causes said restoration means to execute the restoration, even if said switch is not turned on.

4. An ink jet recording apparatus according to claim 1, wherein said restoration means includes a cap for covering said discharge opening, and a suction pump to carry out suction through said discharge opening while said discharge opening is covered with said cap.

5. An ink jet recording apparatus according to claim 1, wherein said restoration means includes an ink receptacle for receiving ink irrelevant to the recording and discharged through said discharge opening.

6. An ink jet recording apparatus according to any one of claims 1 and 2, wherein said recording means includes an ink tank for reserving ink.

7. An ink jet recording apparatus according to any one of claims 1 and 2, wherein said recording means includes a recording head for discharging ink.

8. An ink jet recording apparatus according to claim 1, wherein plural said switches are provided corresponding to plural discharge openings through which different inks are discharged respectively.

9. An ink jet recording apparatus according to claim 1, further comprising an electro-thermal converting element for generating thermal energy to be utilized to discharge ink through said discharge opening.

10. A discharge restoration method comprising steps of:

detecting that an openable cover for covering an ink jet recording head is in an open state;

turning on a switch provided in a position in which said switch is covered with said cover when said cover is in a close state and can be turned on when said cover is in an open state, if said cover is in the open state; and controlling an execution of a restoration of said ink jet recording head, if said detecting means detects that said cover is in the open state, and said switch is turned on, while said control means does not cause the execution of restoration of said ink jet recording head, if said detecting means detects that said cover is in the open state, and said switch is not turned on.

11. A discharge restoration method according to claim 10, wherein said switch is a switch to be turned on if said recording means is exchanged, and if said switch is turned on, the restoration is executed in the controlling step.

12. A discharge restoration method according to claim 11, wherein a time period while said cover is in the open state is measured, and if the time period reaches a predetermined value, the restoration is executed, even if said switch is not turned on.

13. A discharge restoration method according to claim 10, wherein the restoration is suction in which suction is carried out through said discharge opening while said cap covers said discharge opening.

14. A discharge restoration method according to claim 10, wherein the restoration is preparatory discharge in which ink irrelevant to the recording is discharged through said discharge opening.

15. A discharge restoration method according to any one of claims 10 and 11, wherein said recording means includes an ink tank for reserving ink.

16. A discharge restoration method according to any one of claims 10 and 11, wherein said recording means includes a recording head for discharging ink.

17. A discharge restoration method according to claim 10, wherein plural said switches are provided corresponding to plural discharge openings through which different inks are discharged respectively.

* * * * *

UNITED STATES PATENT AND TRADEMARK OFFICE

CERTIFICATE OF CORRECTION

PATENT NO. : 6,502,919 B1
DATED : January 7, 2003
INVENTOR(S) : Tanabe

It is certified that error appears in the above-identified patent and that said Letters Patent is hereby corrected as shown below:

Column 1,
Line 15, "meals" should read -- metals --.

Column 2,
Line 7, "recording-" should read -- recording --.

Column 5,
Line 19, "recording-wait" should read -- recording-waiting --.

Column 6,
Line 48, "A" should read -- As --.

Column 8,
Line 64, "comprising steps" should read -- comprising the steps --.

Signed and Sealed this

Eleventh Day of November, 2003

JAMES E. ROGAN
*Director of the United States Patent and Trademark Office*